United States Patent [19]

Suzuki et al.

[11] 4,255,136

[45] Mar. 10, 1981

[54] FURNACE FOR HEAT TREATMENT OF WIRE MATERIALS

[75] Inventors: Teruo Suzuki; Shigeru Kuwabara, both of Yokohama, Japan

[73] Assignee: Tokyo Shibaura Electric Co., Ltd., Kawasaki, Japan

[21] Appl. No.: 121,034

[22] Filed: Feb. 13, 1980

Related U.S. Application Data

[63] Continuation of Ser. No. 900,319, Apr. 26, 1978, abandoned.

[30] Foreign Application Priority Data

Apr. 30, 1977 [JP] Japan ..... 52-55934

[51] Int. Cl.[3] ..... F27B 9/28

[52] U.S. Cl. ..... 432/143; 432/59; 432/178; 432/223

[58] Field of Search ..... 432/8, 59, 178, 179, 432/223; 34/35, 86; 431/173; 126/92 B

[56] References Cited

U.S. PATENT DOCUMENTS

| | | | |
|---|---|---|---|
| 707,216 | 8/1902 | Duc, Jr. | 431/173 |
| 2,029,580 | 2/1936 | Merkt | 432/179 |
| 2,618,317 | 11/1971 | DuBell | 431/173 |
| 2,668,701 | 2/1954 | Dietrich | 432/8 |
| 3,043,368 | 7/1962 | Nesbitt | 431/173 |
| 3,229,746 | 1/1966 | Wagner et al. | 431/173 |
| 3,721,520 | 3/1973 | Bloom | 432/59 |
| 3,859,786 | 1/1975 | Azelborn et al. | 431/173 |
| 3,930,488 | 1/1976 | Wallis et al. | 126/92 B |
| 3,935,623 | 2/1976 | Mettler | 432/59 |
| 3,994,275 | 11/1976 | Williams | 126/92 B |
| 3,994,275 | 11/1976 | Williams | 126/92 B |
| 4,060,380 | 11/1977 | Bolt | 431/179 |
| 4,140,100 | 2/1979 | Ishihana | 126/92 B |

*Primary Examiner*—Henry C. Yuen

*Attorney, Agent, or Firm*—Cushman, Darby & Cushman

[57] ABSTRACT

A furnace for the heat treatment of wire materials, comprising a cylindrical furnace body having holes at both ends through which a wire material is inserted into and out of the furnace body, a combustion chamber formed within the furnace body, a burner provided at one end portion of the furnace body and adjacent to the combustion chamber, and a discharge pipe mounted near the downstream edge of the combustion chamber for discharging the waste gas. The burner comprises a free space through which the wire material is inserted, a fuel-air mixture chamber surrounding the free space, and injection nozzles communicating with the fuel-air mixture chamber and serving to inject the mixture into the combustion chamber. The injection nozzles are arranged to permit the injected streams of fuel-air mixture to make whirling motions in the same direction along the inner wall of the combustion chamber in such a manner as to be free from direct contact with the wire material running along the axis of the combustion chamber.

2 Claims, 4 Drawing Figures

FURNACE FOR HEAT TREATMENT OF WIRE MATERIALS

This is a continuation of application Ser. No. 900,319 filed Apr. 26, 1978, now abandoned.

BACKGROUND OF THE INVENTION

This invention relates to a furnace for the continuous heat treatment of refractory wire materials like a tungsten wire.

Appended FIG. 1 shows a typical example of conventional furnace for the continuous heat treatment of long wire materials. As shown in the drawing, a plurality of burners 2 are mounted in the wall of a furnace body 3 apart from each other in the running direction of a wire material 1. A fuel-air mixture introduced through a pipe 4 is supplied to these burners 2. Naturally, the wire material 1 is directly heated by the flame spurting from the burners 2. Further, a plurality of discharge ports 5 are provided apart from each other in the running direction of the wire material.

The conventional furnace of this type is defective in that the combustion gas spurting from the burner 2 tends to flow directly into the discharge port 5, resulting in failure to utilize effectively the free space within the furnace. Namely, the conventional furnace brings about a failure to utilize effectively the heat of the flame, leading to an increased fuel gas consumption. Further, the wire material running within the furnace is brought into direct contact with the flame spurting from the burner. This causes local over-heating of the wire material at the portions which have been brought into direct contact with the flame, leading to quality deterioration of the heated wire material and to an increased loss of the wire material caused by oxidation. Still further, the provision of a plurality of discharge ports renders it troublesome and complicated to mount heat exchangers for enhancing the thermal efficiency of the furnace, to mount cooling devices of the burners, etc., leading to a high manufacturing cost of the furnace.

SUMMARY OF THE INVENTION

An object of this invention is to provide a furnace for the heat treatment of wire materials capable of preventing local over-heating of the wire material and preventing direct flow of the combustion gas from the burner to the discharge port and, thus, permitting a decreased loss of the wire material caused by oxidation and enhancing the thermal efficiency of the furnace.

Another object is to provide a furnace for the heat treatment of wire materials permitting a heat exchanger of the burner to be mounted thereto without difficulty.

According to this invention, there is provided a furnace for the heat treatment of wire materials, comprising a cylindrical furnace body having holes at both ends through which a wire material is inserted into and out of the furnace body, a combustion chamber formed within the furnace body, a burner provided at one end portion of the furnace body and adjacent to the combustion chamber, and a discharge pipe mounted near the downstream edge of the combustion chamber for discharging the waste gas. The burner comprises a free space through which the wire material is inserted, a fuel-air mixture chamber surrounding the free space, and injection nozzles communicating with the fuel-air mixture chamber and serving to inject the mixture into the combustion chamber. The injection nozzles are arranged to permit the injected streams of fuel-air mixture to make whirling a spiral motions in the same direction along the inner wall of the combustion chamber in such a manner as to be free from direct contact with the wire material running through the combustion chamber.

In a preferred embodiment of this invention, the injection nozzles are formed in the boundary wall between the combustion chamber and the burner in an inclined fashion with respect to the surface of said boundary wall. Further, it is preferred to mount a heat exchanger in a manner to surround the outer surface of the discharge pipe so as to impart the heat of the waste gas to the air used for burning the fuel.

DETAILED DESCRIPTION OF THE INVENTION

Figure 1:
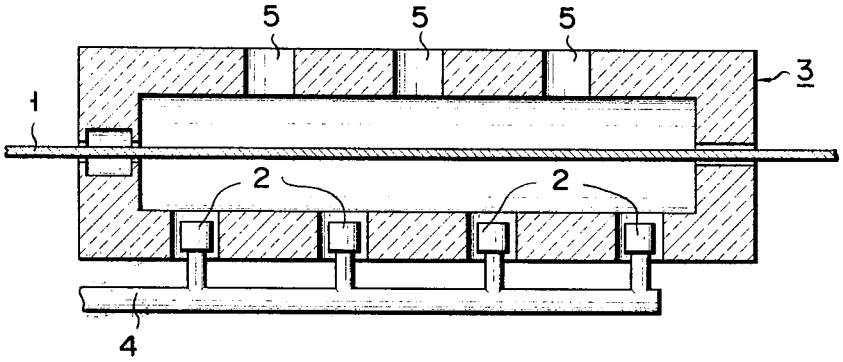
FIG. 1 (PRIOR ART)
FIG. 1 is a schematic cross sectional view of a conventional furnace for the heat treatment of wire materials.
Figure 2:
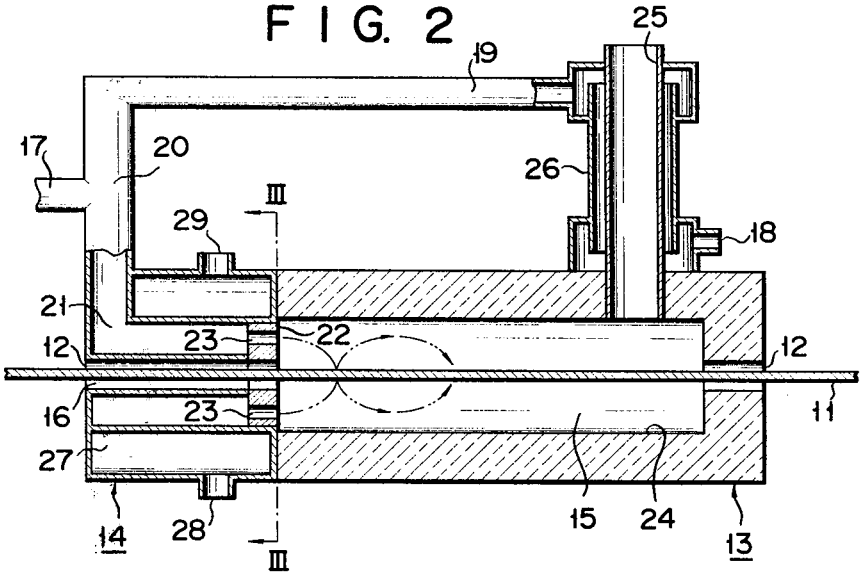
FIG. 2 is a schematic cross sectional view of a furnace for the heat treatment of wire materials according to one embodiment of this invention.

FIG. 2 shows a furnace according to one embodiment of this invention. It is seen that a cylindrical furnace body 13 is provided with holes 12 at both ends through which a wire material 11 runs along the axis of the furnace body 13. A burner 14 is provided at one end portion of the furnace body and a combustion chamber 15 is formed adjacent to the burner 14. As shown in the drawing, the burner 14 comprises a free space 16 through which the wire material 11 is inserted, a fuel-air mixture chamber 21 surrounding the free space 16, and injection nozzles 23 communicating with the combustion chamber 15. A fuel gas introduced from a fuel inlet port 17 and the air introduced from an air inlet port 18 are mixed at a mixing portion 20 and the mixture is supplied to the fuel-air mixture chamber 21. The air introduced from the air inlet port 18 passes through a heat exchanger 26 and a pipe 19 to reach the mixing portion 20. Incidentally, the free space 16 is the same as the hole 12 in the region forming the burner 14.

Figure 3:
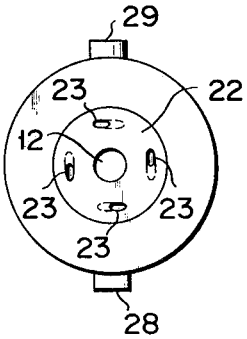
FIG. 3 is a cross sectional view along line III—III of FIG. 2 and shows the direction of injection nozzles.
Figure 4:
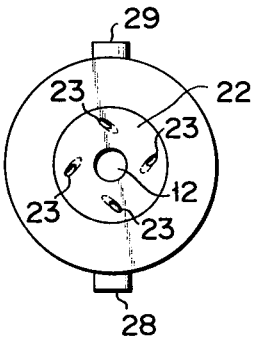
FIG. 4 is a cross sectional view showing a modification of FIG. 3.

It is important to note that as shown in FIGS. 3 and 4 the injection nozzles are formed in a boundary wall 22 between the fuel-air mixture chamber 21 and the combustion chamber 15 in an inclined fashion with respect to the surface of said boundary wall. This arrangement is intended to permit the streams of the fuel-air mixture injected from the nozzles 23 to make whirling notions in the same direction along an inner wall 24 of the combustion chamber 15 in such a manner as to be free from direct contact with the wire material 11 running along the axis of the furnace body 13.

A discharge pipe 25 is mounted near the downstream edge of the combustion chamber 15 for discharging the waste gas. Further, the heat exchanger 26 is provided in a manner to surround the outer surface of the discharge pipe 25 so as to perform heat exchange between the waste gas and the air used for burning the fuel. Still further, a cooling water-circulating device 27 is mounted, if desired, to surround the outer surface of the burner 14. A cooling water is introduced into the device 27 from a cooling water inlet port 28 and discharged from a cooling water outlet port 29.

In the furnace of FIG. 2 it is possible to run the wire material 11 either rightward or leftward.

As described above, the furnace of FIG. 2 has the injection nozzles 23 inclined with respect to the bundary wall 22. Accordingly, the fuel-air mixture is injected from the injection nozzles such that the streams of the injected mixture flows whirling in the same direction along the inner wall of the combustion chamber. Of course, the flame caused by ignition of the mixture makes a whirling motion along the inner wall of the combustion chamber, resulting in that the wire material 11 is free from direct contact with the flame. It is also important to note that the heat of the waste gas is utilized for preheating the air introduced from the air inlet port 18, namely, the air is preheated in passing through the heat exchanger 26.

FIGS. 3 and 4 shows examples of nozzle arrangements. What should be noted is that it suffices to arrange the nozzles to form spiraling flames within the furnace.

The furnace of this invention is advantageous in that local over-heating of the wire material can be prevented because the heating of the wire material is effected by the flame whirling along the inner wall of the combustion chamber and by the heat radiated from said inner wall. What is also important is that the waste gas is discharged from a single discharge pipe mounted near the downstream edge of the combustion chamber. This construction is effective for preventing a direct flow of fuel-air mixture from the burner to the discharge pipe and, thus, enhances the thermal efficiency of the furnace. The provision of a single discharge pipe also facilitates mounting a heat exchanger. Naturally, the particular arrangements mentioned serve to simplify the overall construction of the furnace, leading to marked reduction in the manufacturing cost, maintenance cost, etc. of the furnace.

What we claim is:

1. A furnace for the heat treatment of wire materials, comprising a cylindrical furnace body having holes at both ends through which a wire material is inserted into and out of the furnace body, a combustion chamber formed within the furnace body, a burner provided at one end portion of the furnace body and adjacent to the combustion chamber, and a discharge pipe mounted near the downstream edge of the combustion chamber for discharging the waste gas, said burner comprising a free space through which the wire material is inserted, a fuel-air mixture chamber surrounding the free space, and injection nozzles communicating with the fuel-air mixture chamber, and serving to inject the fuel-air mixture into the combustion chamber, said injection nozzles being formed in a boundary wall between the combustion chamber and the burner in an inclined fashion with respect to the surface of said boundary wall so as to permit the injected streams of fuel-air mixture to make whirling motions in the same direction along the inner wall of the combustion chamber in such a manner as to be free from direct contact with the wire material running along the axis of the combustion chamber; said boundary wall comprises a planar surface completely separating said combustion chamber and said burner, said planar surface being perpendicular to said axis and abutting the inner wall of said combustion chamber;

said combustion chamber inner wall comprising means for radiantly heating said wire material when said fuel-air mixture is injected into said combustion chamber, thereby enabling the wire material to be synergetically heated by both flames whirling along the inner wall of the combustion chamber and heat radiated from said inner wall.

2. The furnace according to claim 1, which further comprises a heat exchanger mounted to surround the outer surface of the discharge pipe so as to impart the heat of the waste gas to the air used for burning the fuel.

* * * * *